US005840165A

United States Patent [19]

Turner

[11] Patent Number: 5,840,165

[45] Date of Patent: Nov. 24, 1998

[54] ELECTROLYTIC TREATMENT OF MATERIAL

[75] Inventor: Bernard Turner, Preston, United Kingdom

[73] Assignee: British Nuclear Fuels plc, United Kingdom

[21] Appl. No.: 968,212

[22] Filed: Nov. 12, 1997

Related U.S. Application Data

[62] Division of Ser. No. 586,767, filed as PCT/GB95/01267 Jun. 1, 1995.

[30] Foreign Application Priority Data

Jun. 2, 1994 [GB] United Kingdom ..... 9411063

[51] Int. Cl.[6] ..... C25D 17/00

[52] U.S. Cl. ..... 204/198; 204/273; 204/275; 204/277

[58] Field of Search ..... 204/198, 273, 204/275, 277

[56] References Cited

U.S. PATENT DOCUMENTS 5,435,899 7/1995 Gimenez et al. ..... 204/297 R

*Primary Examiner*—Arun S. Phasge

*Attorney, Agent, or Firm*—Sheridan Ross PC

[57] ABSTRACT

A method of treating a body of conducting material electrolytically which comprises the steps of placing the material to be treated in an aqueous oxidising electrolyte, passing an electric current through the electrolyte and the material to be treated and sparging the electrolyte with gas. The material to be treated is placed in a basket comprising a conducting frame having an insulating container fitted therein, the basket being insertable in and removable from the electrolyte as desired. The insulating container is removable from the conducting frame, the frame having retaining means for receiving the insulating container. The container includes a base having perforations to allow electrolyte to contact the material to be treated. The electrolyte is sparged with gas in the region where the material to be treated is in contact with it, the gas being supplied by a plurality of pipes (21, 22) extending across the electrolyte at a location beneath the perforated base of the insulating container. The pipes each have a plurality of gas outlet holes directed towards the material to be treated.

8 Claims, 4 Drawing Sheets

ELECTROLYTIC TREATMENT OF MATERIAL

This application is a divisional of application Ser. No. 08/586,767, filed as PCT/GB95/01267 Jun. 1, 1995.

The present invention relates to the electrolytic treatment of material. In particular, it relates to apparatus and a method for treating a body of conducting material.

The use of gas bubbling or sparging in electrochemical process is known. Examples of such processes are disclosed inn Patent Specifications GB 1091157, GB 1392705, GB 2182259A, U.S. Pat. Nos. 3,875,041 and 4,263,120. However, in the constructions described the bubbling or sparging is carried out in a controlled manner at electrode surfaces in order to promote processes such as electrodeposition or electrolytic etching.

Applicants' GB2269601A describes a method of treating scrap graphite contaminated with metal electrolytically whereby graphite and metal may be separated and treated or disposed of in different ways. The use of sparging is proposed.

However, GB 2269601A does not envisage a practical arrangement for carrying out the sparging and it is therefore an object of the present invention to provide such a practical arrangement. The present invention provides an apparatus and method for electrolytically treating bodies of conducting material such as graphite in a manner similar to that described in GB2269601A.

According to the present invention there is provided a method of treating a body of conducting material electrolytically which comprises the steps of placing the material to be treated in an aqueous oxidising electrolyte, passing an electric current through the electrolyte and the material to be treated and sparging the electrolyte with gas, characterised in that the material to be treated is placed in a basket comprising a conducting frame having an insulating container fitted therein, the basket being insertable in and removable from the electrolyte as desired, wherein the insulating container is removable from the conducting frame, the frame having retaining means for receiving the insulating container, the container including a base having perforations to allow electrolyte to contact the material to be treated and wherein the electrolyte is sparged with gas in the region where the material to be treated is in contact with it, the gas being supplied by a plurality of pipes extending across the electrolyte at a location beneath the perforated base of the insulating container, the pipes each having a plurality of gas outlet holes directed towards the material to be treated.

Sparging of the electrolyte in the manner described allows a substantial surface area of the electrolyte around the material to be treated to be sparged simultaneously.

The material to be treated may comprise a porous mass. It may comprise scrap graphite to be separated from metal adhered thereto. The metal may for example comprise one or more hazardous, eg toxic or radioactive, elements such as uranium and or plutonium. Such elements may be present in compound form, eg as oxides.

The electric current may be a directional current.

The conducting material to be treated, eg graphite body, disintegrates in the electrolyte and any metal present dissolves at an accelerated rate under the influence of the electric current. The metal can also break off from the graphite and may dissolve over a longer time period in the electrolyte. The graphite so treated may therefore be separated by filtering and washing. Where the graphite has been contaminated with uranium and/or plutonium the separation by this process is sufficiently successful to allow the graphite to be disposed of in a conventional manner rather than by special means required for hazardous, radioactive materials.

Where scrap graphite is treated by the method of the present invention the scrap graphite may contain less than 40 per cent, in most cases less than 10 per cent by weight, eg from 2 to 6 per cent by weight of contaminant metal so that the metal is a minor by-product to the separation process (in terms of its quantity).

The electrolyte is desirably a strong acid, eg nitric and/or sulphuric acid. Its concentration is preferably in the range 5 to 70 per cent by weight of acid: aqueous solution. In general, the process works more rapidly as the concentration of the acid increases. The process speed also increases with the further assistance of (a) an elevated electrolyte temperature, eg 30 to 80 degrees Celsius; also with (b) mechanical agitation or stirring of the electrolyte and also with (c) an increase in applied electric current or (d) input of additional energy from other sources, eg ultrasonic devices.

The mean applied electric current needs to be greater than the minimum current required for the reaction, which is typically 10 milliamps per $cm^2$.

Where additional mechanical stirring of the electrolyte is applied this may be the use of a conventional paddle or agitator. Alternatively, ultrasonic stirring may be used.

The electrolytic system containing the electrolyte may comprise an acid bath into which the material to be treated is placed. The material may be contained in a basket which may be insertable in and removable from the electrolyte as desired. The basket may conveniently comprise a conducting, eg metal, frame having an insulating container fitted therein. The insulating container, which may for example be made of plastics material, may be fixed to or removable from the metal frame. The container may itself be made up of individual insulating boards fitted together. The frame may contain a receiving means, eg ledge for receiving the container at a height above the base of the frame.

Desirably, the said pipes which provide delivery of the sparging gas are located beneath the said insulating container. The purpose of the said insulating container is to hold a charge of material to be treated, eg a mass of scrap-graphite whist maintaining electrical insulation between an electrical terminal applied to the charge of material and a terminal of opposite polarity in the electrical cell. The said container desirably includes a base having perforations, slits or holes therein to allow electrolyte in the bath to contact the material to be treated. Where a conducting frame is employed to hold the said insulating container the conducting frame may have a plurality of sites, eg tabs having holes therethrough, at which electrical terminals all of the same polarity may be connected, eg by fasteners such as nuts and bolts to the frame. A plurality of conducting rods or bars, eg made of stainless steel, may be connected to the said frame beneath the base of the said insulating container. The rods or bars which may run parallel to one another may extend in use through the electrolyte at a level below the said gas sparging pipes. The said rods or bars provide a multiple electrode structure in the electrolyte beneath the said container.

Desirably, the gas sparging pipes run at an angle to, preferably about 90 degrees to the said rods or bars.

A further plurality of gas sparging pipes may be provided beneath the said rods or bars whereby in use gas delivered thereby may be applied to the rods or bars.

We have found that sparging of the electrolyte by gas delivered by the first mentioned sparging pipes in the manner described above has the following benefits. Firstly, it helps remove saturated gases, such as $NO_2$ from $HNO_3$, which cause slowing down of the electrochemical reaction. Secondly, it provides mechanical energy to help the treated material break up. Thirdly, it frees grains of the broken up treated material. Fourthly, it mixes the electrolyte solution so that the electrolyte in contact with the material to be treated is kept in fresh supply. The rate of delivery of the sparging gas may be chosen by suitable experimentation. If the rate is too great the current through the cell falls and this fall can be measured by a suitable meter.

Where a further supply of sparging gas is provided beneath the said rods or bars which are negative electrodes the gas is desirably oxygen or air which promotes the conversion of product formed at the negative electrodes eg reconversion of $HNO_3$ from $HNO_2$.

The present invention provides a method for recovering scrap conducting material, eg scrap graphite, and has all of the advantages described in GB2269601A.

Where an insertable basket including an insulating container having a perforated base is employed to contain material to be treated in an electrolyte bath, the positive electrical terminal may comprise one or more blocks placed on the mass of material. Each block may be made of graphite and may be adapted, eg by having an internal screw thread, to receive a member connected to a conducting cable. Alternatively, or in addition, the positive electrode for applying electric current may be provided by one or more blocks of metal, eg stainless steel, in contact with the material to be treated and/or by a collar of metal, eg stainless steel, inside the basket, eg slidably located against the inner wall thereof, in contact with the material to be treated. Desirably, the electrolyte reaches a level in the said insulating container which is between the top and bottom levels of the material to be treated whereby the positive electrical terminal or contact, eg graphite or metal block(s), to the material to be treated is kept outside the electrolyte. This reduces the possibility of corrosion of the said contact. In the said arrangement electrical current flows (from positive to negative) around the circuit comprising in turn the electrical contact to the material to be treated; the material to be treated; the electrolyte; the rods or bars; the frame of the basket and the negative terminals connected to the frame.

BRIEF DESCRIPTION OF THE DRAWINGS

Embodiments of the present invention will now be described by way of example with reference to the accompanying drawings, in which:

As shown in FIGS. 1 to 3 a basket structure comprises and rectangular frame 1 made of metal, eg stainless steel. The frame 1 comprises at its front face or side as shown in FIG. 1 flat elongate, upright plates 3*a*, 5*a* having flat elongate cross plates 7*a*, 9*a*, 11*a*, 13*a* and 15*a* extending between them at right angles thereto. Similarly, the frame 1 comprises as its end face as shown in FIG. 2 flat, elongate upright plates 3*b* and 5*b* having flat elongate, cross plates 7*b*, 9*b*, 11*b*, 13*b* and 15*b* extending between them at right angles thereto.

The face of the frame 1 opposite to the front face containing the plates 3*a* and 5*a* comprises (in a manner similar to the front face) flat elongate upright plates (not shown) 3*c*, 5*c* having flat, elongate cross plates (not shown), 7*c*, 9*c*, 11*c*, 13*c* and 15*c* extending between them at right angles thereto. Likewise, the face of the frame 1 opposite to the face containing the plates 3*b*, 5*b* comprises (in a similar manner) flat elongate upright plates (not shown) 3*d*, 5*d* having flat elongate cross plates (not shown) 7*d*, 9*d*, 11*d*, 13*d* and 15*d* extending between them at right angles thereto.

Figure 3:
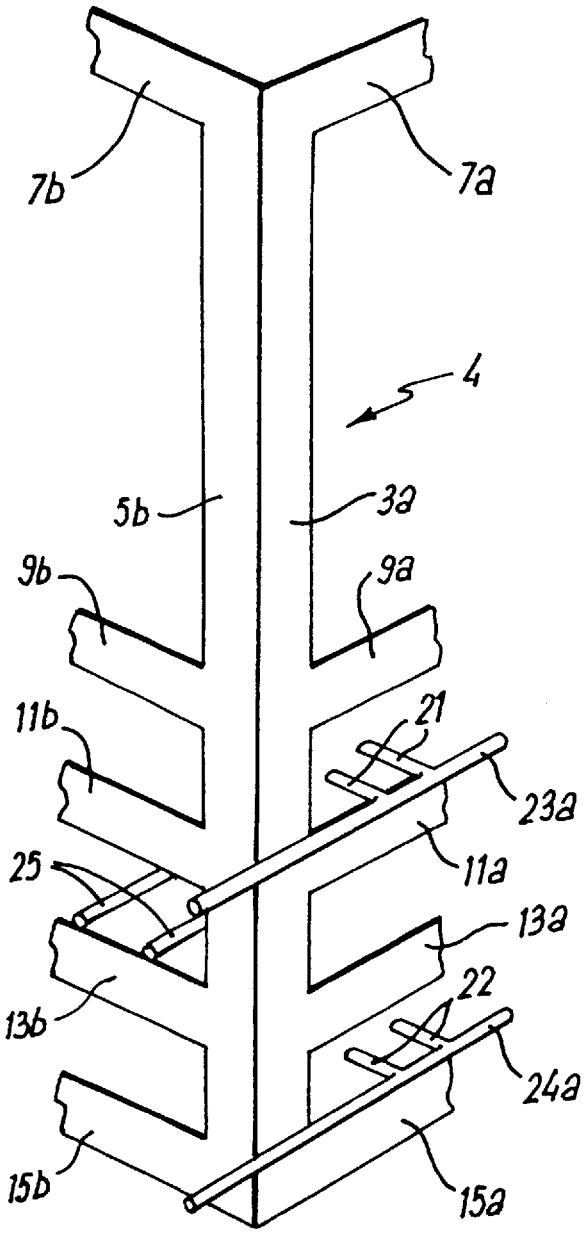
FIG. 3 is a perspective view in the direction X shown in FIGS. 1 and 2.

The plates 3*a* and 5*b*, the plates 5*a* and 3*d*, the plate 5*d* and 3*c* and the plates 5*c* and 3*b* are respectively joined together in pairs each pair forming a unitary upright corner member 4 having its respective plates forming a right angle to one another. Thus, the frame 1 has four upright corner members 4 as shown in FIG. 3.

The upper cross plates on each side or face of the frame 1 via each of the plates 7*a*, 7*b*, 7*c*, 7*d* has a plurality of tabs 15 upwardly projecting therefrom. The tabs 15, which may comprise metal plates welded to the upper cross plates, are provided with holes 17. A nut and bolt (not shown) are attached together through each hole 17 to provide a means for securing an electrical terminal to the frame 1 at each hole 17 in a manner similar to that commonly employed for car battery terminals. Thus, a plurality of terminal sites are provided around the top of the frame 1 at the holes 17.

A ledge 19 projects inwardly from the cross plates 9*a*, 9*b*, 9*c* and 9*d* of the frame 1. The ledge 19 may for example be a metal ledge welded to the cross plates 9*a*, 9*b*, 9*c* and 9*d*. The ledge 19 extends continuously all around the inner boundary of the frame 1 formed by the plates 9*a*, 9*b*, 9*c* and 9*d*.

A plurality of gas pipes 21 is fitted to run between and to be supported by the plates 11*a* 11*c*. The pipes 21 also extend between gas pipes 23*a*, 23*b* (23*b* not shown) running parallel to the plates 9*a*, 9*c*. The pipes 21 are joined at their respective ends to the pipes 23*a*, 23*b* so that gas from a common source (not shown) fitted to the pipe 23*a* may be delivered along the pipe 23*a* and the pipes 21 and likewise, a plurality of gas pipes 22 parallel to and below the pipes 21 are fitted to run between and to be supported by the plates 15*a*, 15*c*. The pipes 22 are also extended between and are joined to gas pipes 24*a*, 24*b* (24*b* not shown) running parallel to the pipes 23*a*, 23*b*. The pipes 22 are joined at their respective ends at the pipes 24*a*, 24*b* so that gas from a common source fitted to the pipe 24*a* may be delivered along the pipe 24*a* and the pipes 22 and extracted from the pipe 24*b*. Each of the pipes 21 and 22 has a series of small diameter gas outlet holes (not shown) provided in its upper surface.

A plurality of conducting rods 25, eg made of stainless steel, extend below gas pipes 21 and above the gas pipes 22 between the plates 13*b* and 13*d*. The rods 25 run at right angles to the pipes 21 and 22.

Figure 4:
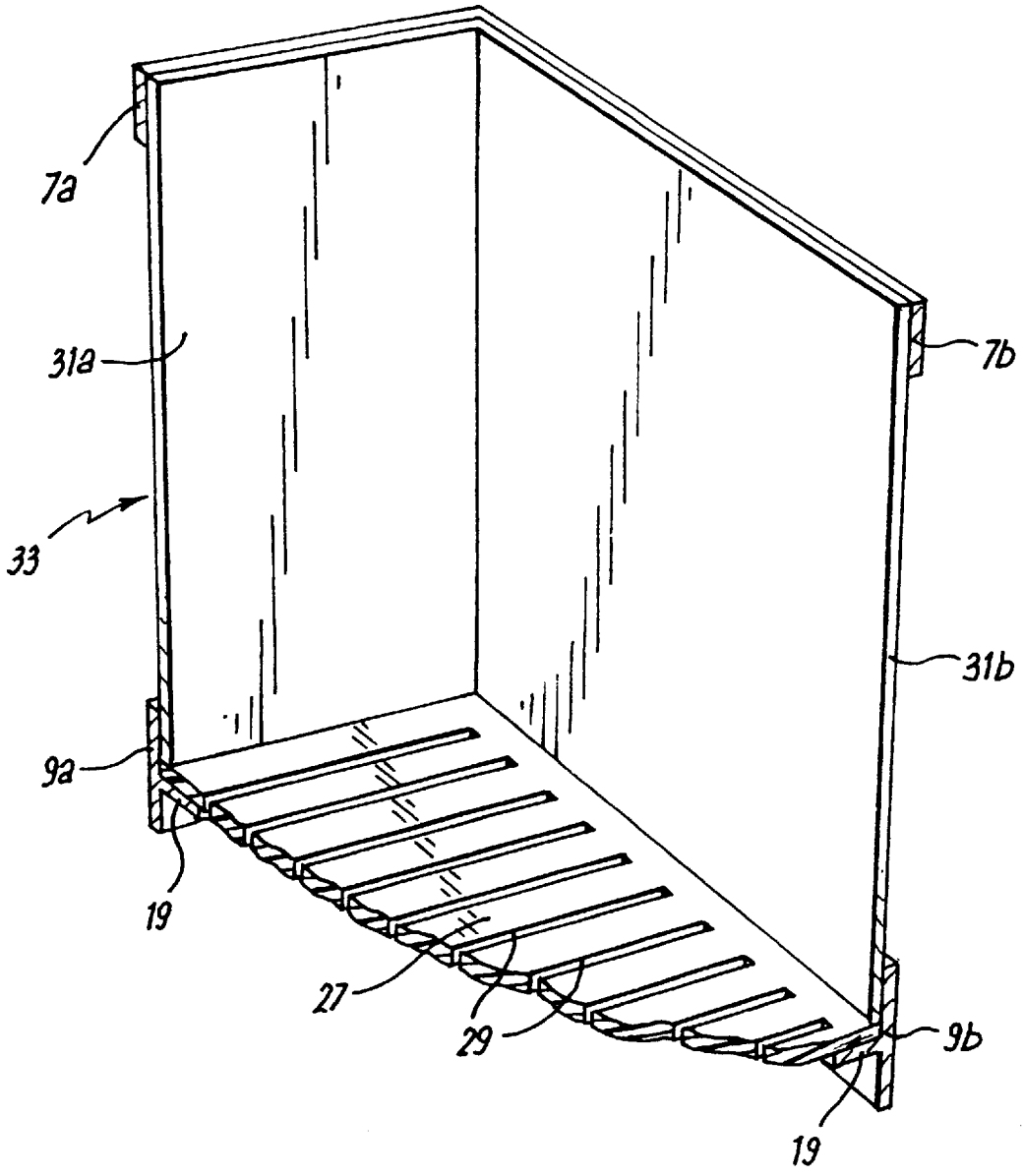
FIG. 4 is a perspective view in the direction Y shown in FIGS. 1 and 2 of an insert for the basket structure shown in FIGS. 1 and 2.

FIG. 4 shows a view toward one of the corner members 4 from inside the frame 1. A board 27 made of plastics material is inserted inside the frame 1 and is fitted to abut against and to be supported by the ledge 19. The board 27 has parallel slits 29 formed through its thickness to extend between its upper and lower faces. Four further boards 31*a*, 31*b*, 31*c*, 31*d* (31*c*, 31*d* not shown) each made of plastics material are fitted inside the frame 1 each in an upright position adjacent to the respective sides of the frame 1. The ends of the boards 31*a*, 31*b*, 31*c*, 31*d* form push fits together and their lower edges abut against the board 27 whereby the boards 27, 31*a*, 31*b*, 31*c* and 31*d* form an open plastics box structure 33 having no gaps apart from the slits 29 which form perforations in the base board 27.

In use, conducting material to be treated, eg metal contaminated graphite, (not shown) is placed inside the box structure 33. The material to be treated does not reach the top of the box structure 33 so that the material does not touch the metal of the frame 1. A plurality of electrical terminals (not shown) are fitted to the frame 1 at the holes 17 in the manner described above. The basket comprising the frame 1 including the box structure 33 and charge of material to be treated is then lowered into a tank containing strong acid, eg concentrated nitric acid. The acid reaches an intermediate level indicated by broken line L in FIGS. 1 and 2. Finally, one or more heavy conducting, eg graphite, blocks (not shown) are placed on top of the material to be treated above level L whereby the blocks do not make contact with the acid. Each of the blocks has an electrical terminal attached thereto. For example, each block may be tapped to receive a screw threaded member attached to a heavy duty conductor.

A direct voltage is applied between (a) the terminals attached to the frame 1 at the holes 17 which are arranged to be negative terminals and (b) the terminal or terminals attached to the heavy block or blocks which are arranged to be positive. Electrical current thereby flows in the electrical circuit comprising in turn (from positive to negative) the heavy block(s); the material to be treated; the acid electrolyte, the conducting rods, the frame 1 and the terminals at the holes 17. The box structure 33 maintains insulation between the positive terminal connected to the material to be treated and the negative structure including the frame 1.

Gas, eg air or nitrogen, is admitted along the pipes 21 via the pipe 23*a* and along the pipes 22 via the pipe 24*a* and causes sparging in the acid in the regions where the gas enters the electrolyte through the holes. The sparging from the pipes 21 causes stirring of the electrolyte throughout a wide region of the acid and material to be treated inside the box structure 33 by passage of the sparging gas through the openings provided by the slits 29. The sparging from the pipes 22 provides cleaning of the negative rods 25 inside the electrolyte.

The material to be treated is broken down and consumed in the acid. The box structure 33 is recharged before the level falls below the electrolyte level L, so that the heavy blocks (providing terminals) remain outside the electrolyte. Using a basket structure as shown in the accompanying drawings in a tank of acid (not shown) forming an electrolytic cell as described the following experimental examples were carried out to demonstrate the benefit of employing sparging of the electrolyte in the treatment of solid conducting material, eg contaminated graphite.

EXAMPLE 1

Figure 1:
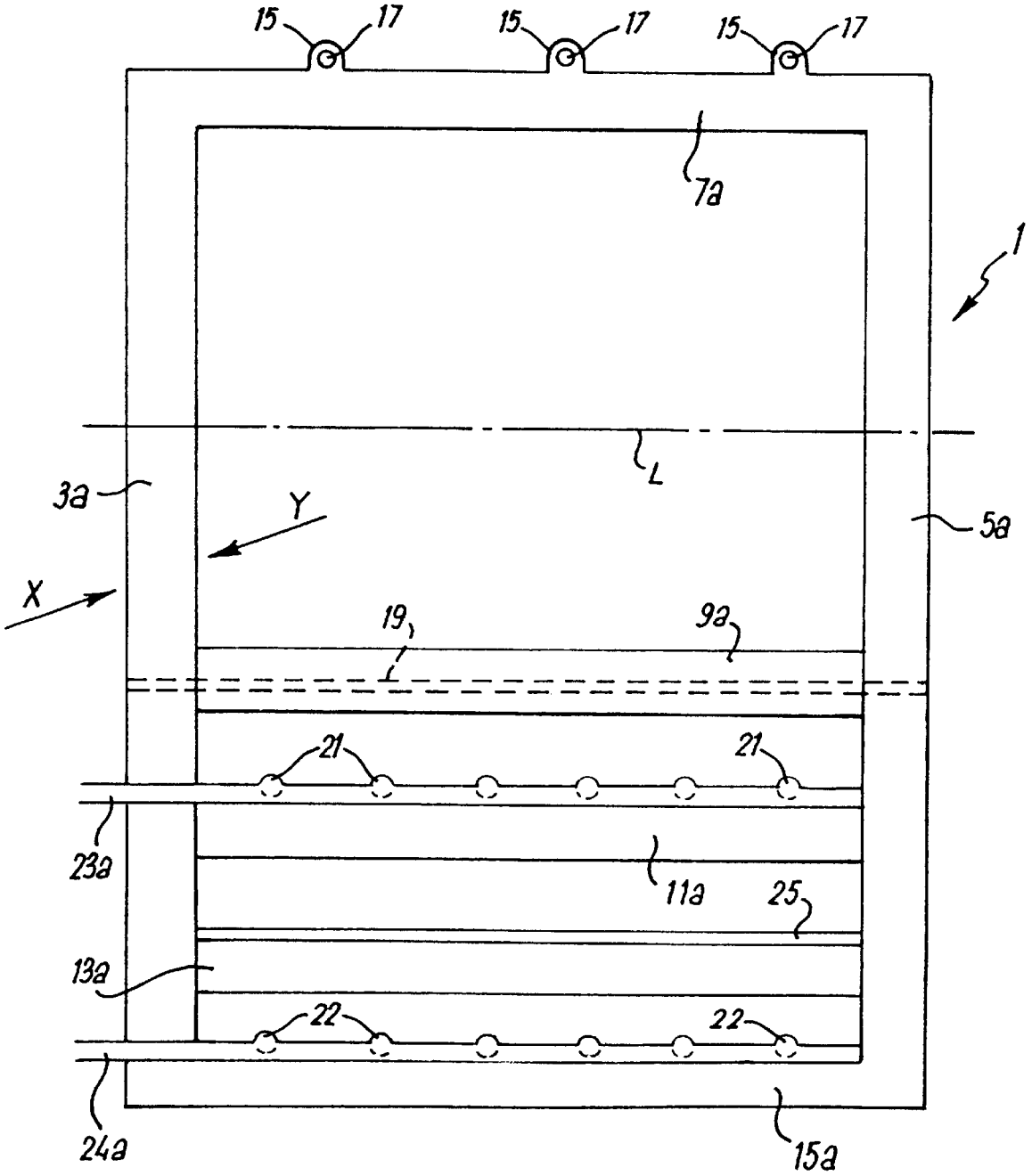
FIG. 1 is a front view of a basket structure embodying the present invention.
Figure 2:
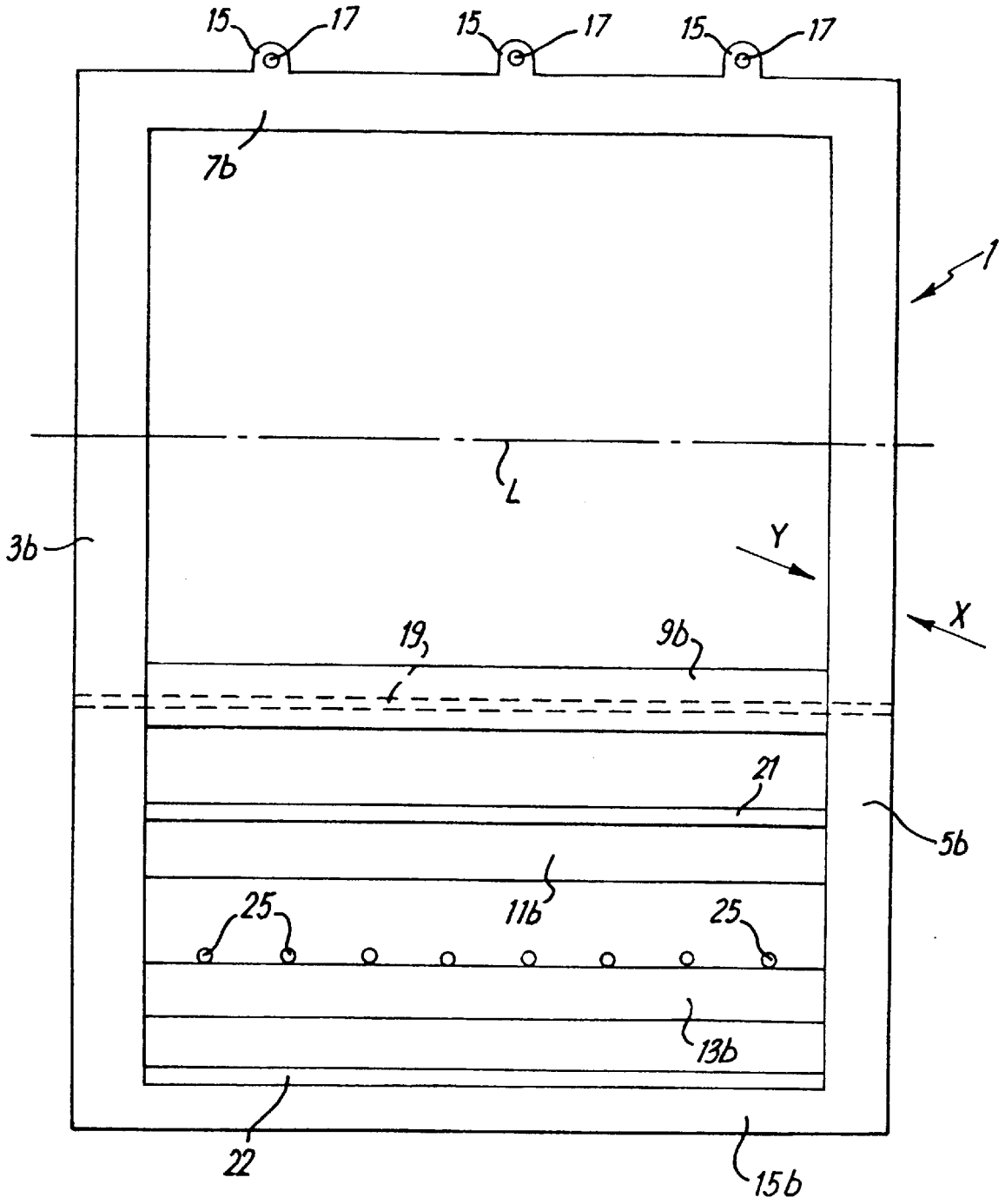
FIG. 2 is an end view of part of the basket structure shown in FIG. 1.

A basket structure as shown in FIGS. 1 to 3 containing an insert box structure 33 as in FIG. 4 was charged with scrap graphite in the manner described above and incorporated in an electrolytic bath containing nitric acid. An electrical current of 250 amps was passed through the cell containing the scrap graphite for 24 hours. The scrap graphite mass disintegrated and fell through the openings provided by the slits 29 in the structure 33 at a rate of 400 grammes per hour. The experiment was repeated under similar conditions but with the scrap graphite and electrolyte in the structure 33 sparged with air. The graphite in this case fell through the slits 29 at a rate of 1300 grammes per hour.

The whole experiment was repeated several times and each time the provision of sparging improved the fall out rate of graphite grains compared with the case with no sparging applied.

EXAMPLE 2

A basket structure as shown in FIGS. 1 to 3 containing an insert box structure 33 as shown in FIG. 4 was charged with scrap graphite in the manner described above. The scrap graphite was electrolysed continuously for a period of 144 hours without sparging. The rate at which the graphite fell through the slits 29 fell gradually from an initial rate of 400 grammes per hour to 140 grammes per hour after 144 hours. The experiment was repeated using similar conditions but also with sparging as in Example 1. The initial rate of graphite falling through the slits 29 was 1300 grams per hour and this was reduced to 600 grams per hour after 144 hours. Thus the fall out rate of graphite was higher at all times using sparging.

EXAMPLE 3

A piece of scrap graphite was treated electrolytically as in Examples 1 and 2 without sparging. The acid employed as electrolyte was saturated with $NO_2$ gas. After applying the electrical current for an hour the graphite had not started to break down at all because of the presence of the $NO_2$. The acid was then sparged with air as in Example 1 to remove the saturated $NO_2$ and the electrical current was applied again. This time the graphite piece began to break down immediately. This illustrates that $NO_2$ saturation stops the electrolytic reaction and that sparging is highly beneficial to remove the $NO_2$ and promote the reaction.

I claim:

1. An apparatus for electrolytically treating electrically conducting material by placing material to be treated in an aqueous oxidizing electrolyte, passing an electric current through said electrolyte and said material to be treated and sparging said electrolyte with gas, the apparatus comprising:

a) an electrically conducting frame in which is received an insulating liner for insertion in the electrolyte, said liner including a perforated base for permitting entry of the electrolyte;

b) a plurality of pipes extending beneath said perforated base of said insulating liner, said pipes each having a plurality of gas outlet holes directed towards said perforated base;

c) whereby in use of said apparatus, said material to be treated is placed within said liner in contact with said electrolyte, said conducting frame and said electrically conducting material coupled to opposite poles of a source of electric current; and d) whereby gas is passed through said pipes to sparge said electrolyte in a region where said electrolyte is in contact with said material to be treated.

2. An apparatus according to claim 1 and wherein a plurality of conducting rods or bars are connected to the frame beneath the base of said insulating liner.

3. An apparatus according to claim 2, wherein said rods or bars run at an angle to said gas sparging pipes.

4. An apparatus according to claim 2, wherein a further plurality of gas sparging pipes are provided beneath said rods or bars to facilitate sparging of the electrolyte in the region of said rods or bars.

5. An apparatus according to claim 2, wherein a further plurality of gas sparging pipes are provided beneath the rods or bars to facilitate sparging of the electrolyte in the region of said rods or bars.

6. An apparatus according to claim 1, wherein said liner is not self-supporting.

7. An apparatus according to claim 1, wherein said liner is directly supported by said electrically conducting frame.

8. An apparatus according to claim 1, wherein said liner is composed of individual boards forming faces of said liner.

* * * * *